United States Patent [19]

Blackburn

[11] Patent Number: 4,532,488

[45] Date of Patent: Jul. 30, 1985

[54] ELECTRIC MOTOR PROTECTION SWITCHES

[75] Inventor: Arthur M. Blackburn, Buxton, England

[73] Assignee: Otter Controls Limited, Buxton, England

[21] Appl. No.: 573,092

[22] Filed: Jan. 23, 1984

[30] Foreign Application Priority Data

Jan. 21, 1983 [GB] United Kingdom ..... 8301624

[51] Int. Cl.[3] ..... H01H 61/00; H01H 71/16

[52] U.S. Cl. ..... 337/111; 337/113; 337/372

[58] Field of Search ..... 337/111, 113, 372

[56] References Cited

U.S. PATENT DOCUMENTS

| | | | |
|---|---|---|---|
| 2,860,208 | 11/1958 | Epstein | 337/111 |
| 3,023,287 | 2/1962 | Epstein | 337/111 |
| 3,569,888 | 3/1971 | Taylor | 337/113 |
| 4,151,501 | 4/1979 | Taylor | 337/372 |

*Primary Examiner*—Harold Broome

*Attorney, Agent, or Firm*—Pollock, Vande Sande & Priddy

[57] ABSTRACT

An overload protection switch for an electric motor comprises a bimetallic switch-actuating element carrying a moving contact of the switch, a first terminal part having an extension which defines a mounting for the bimetal, and a second terminal part having an extension which mounts a fixed contact of the switch, the first and second terminal parts being received in a moulded plastics switch body portion. In contrast to prior art switches of this type where the terminal parts were manufactured of material having a low electrical resistance, the invention manufactures these parts of high resistance material selected such that under very high overload current levels the resistance heating in the terminal parts does not significantly determine the switching characteristics of the switch on account of the overwhelmingly predominant bimetallic heating, but towards the other end of the overload current scale the self-heating of the terminal parts significantly affects the switch operation.

10 Claims, 11 Drawing Figures

KEY:

= PRIOR ART DEVICES OF GB 903807

= DEVICE ACCORDING TO INVENTION

FIG.2-6.
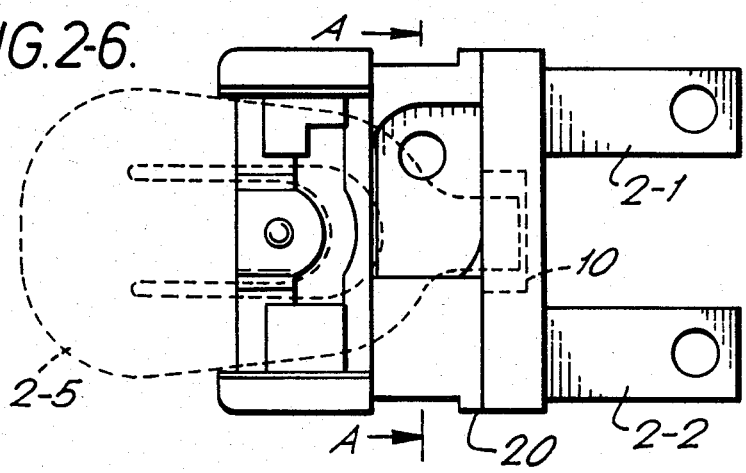
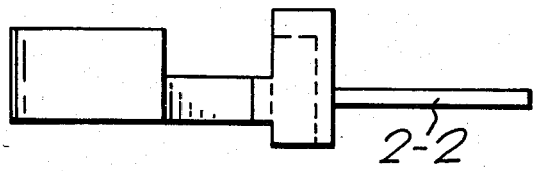
FIG.2-7.
FIG.2-8.
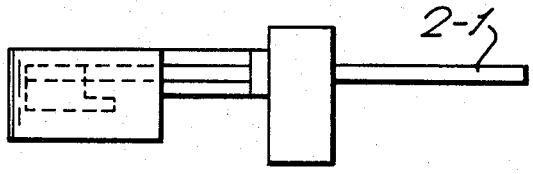
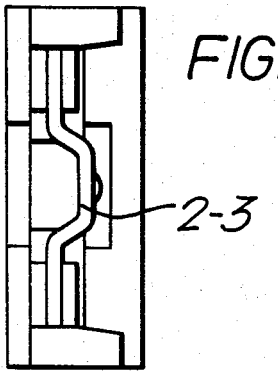
FIG.2-9.
FIG.2-10.
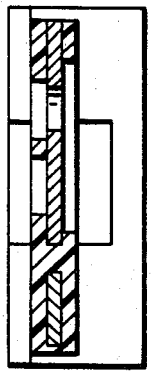

ELECTRIC MOTOR PROTECTION SWITCHES

FIELD OF THE INVENTION

This invention concerns improvements in or relating to electric switches and more particularly is concerned with switches employing thermally-responsive bimetallic switch-actuating elements. The invention is especially, though not exclusively, concerned with the application of such switches in the field of electric motor protection.

BACKGROUND OF THE INVENTION

The principle of protecting electric motors using bimetal switches such as that shown in British Pat. No. 903807 is well known. The protector switch is series connected with the motor windings and is required to open circuit when the motor is overloaded before the windings reach their temperature limit, and yet must allow the full load current to pass at all ambient temperatures experienced by the motor in order that the motor be able to develop its full designed load. This is particularly difficult in the case of permanent magnet low voltage motors as used for example in motor vehicles. In addition to providing a large torque from a small package, such motors are also required to perform satisfactorily and be protected in ambient temperatures from −40° C. to +80° C. in order to meet the car manufacturer's specifications.

In addition to having to operate through such a wide range of ambient temperatures, such motors must also be constructed in a light weight manner in order to reduce the weight of the vehicle and improve its fuel consumption. The light weight construction means that the motor has a low thermal mass and its temperature rises quickly when it is loaded, and yet it must be capable of producing the full torque specified by the vehicle manufacturer. Motor protector devices are therefore subject to a number of conflicting requirements in their performance characteristics; the development of large torques requires large motor currents to be sustained for short periods without nuisance tripping of the protector, and yet the protector must protect against the motor stall current which decreases with time because the associated high winding temperatures cause an increase in the resistance of the winding. A typical automotive window lift motor, for example, is required to work at a high load for a short period (e.g. 6 seconds) with currents close to a 20 ampere stall current without the protector nuisance tripping. The current heating of the armature under stall conditions leads to an increase in the temperature of the windings, and a decrease in the stall current to approx. 12 amperes It can thus be seen that the protector must be relatively insensitive to large currents, yet be sensitive to low currents over an extended period.

Devices such as that shown in British Pat. No. 903807 are used extensively in the protection of low voltage electric motors. The characteristics of these devices can be shown by plotting the break time with varying currents. FIG. 1 of the accompanying drawings in which the vertical axis represents current measured in amperes and the horizontal axis represents break time in seconds, shows that the characteristic for prior art devices of the type of British Pat. No. 903807 as shown by the continuous lines in FIG. 1 is relatively flat, and this leads to a requirement for a number of alternative switches having different bimetal resistances so as to provide the required characteristic at the high current or low current end. It is frequently difficult to manufacture a switch having the required characteristics at both ends of the time scale, and commonly the protector utilized is a compromise between both requirements. Nevertheless, protectors of this type have provided adequate protection for motors constructed in traditional ways.

The design of motors of even lighter construction has required the characteristics of such protector switches to be changed in order to give longer break times on high currents and to lower the value of the current at which the protector will ultimately trip. One approach to this requirement has been to manufacture the protector from two pieces of bimetal mounted on a chassis. A thinner bimetal is mounted back to back with a thicker bimetal and is used to give an initial increase in contact pressure between a movable contact on the thicker bimetal and a fixed contact on the chassis in order to raise the operating temperature of the protector and provide a longer break time under large currents. The opposite action occurs under falling temperature and the remake time is also increased, thus ensuring that the energy input to the motor under stall is limited so that the windings do not exceed a safe working temperature. Protectors of this construction are slow make and break protectors and require large silver contacts in order to withstand the arcing action; this arcing action also leads to radio interference on car radios, etc., and may influence the working of electronic devices on the car. The manufacture of the devices is complicated and the performance characteristics can vary considerably with life as the silver contacts are worn by the arcing, causing changes in the geometry of the bimetal.

Other known devices use bimetal with separate heater bridges or an internal or external heater in order to modify the device characteristics. The performance of such protectors, however, varies with the orientation of the protector, and they have a complicated construction in order to transfer the heat from the heating member to the bimetal.

Some of the disadvantages of the device shown in British Pat. No. 903807 have been minimized by a method described in German Patent Application No. P2811503.9-32. In this application, a bimetal carrying terminal of the protector device is attached to a metal brush holder of the electric motor or to the thick wire windings of an interference suppressor. During a short period of high current, the comparatively cool metal brush holder or windings acts as a heat sink and reduces the rate of temperature rise of the bimetal in the device so as to prolong the first break time. In the case of a prolonged stall or overload, the metal brush holder or windings heat up and heat then flows from the brush holder or winding into the bimetal via the brass terminal, and this helps the bimetal to operate under a lower current. The heat input also slows down the cooling of the bimetal; this leads to an extended remake time and lower energy input into the motor with consequently lower winding temperatures. This method clearly can only be applied to motors having suppressors or comparatively substantial metal parts in the brush holder construction.

SUMMARY OF THE INVENTION

The present invention resides in the concept of manufacturing one or more of the terminals and contact and bimetal mounting parts of a switch such as, for example, that described in British Pat. No. 903807, such parts conventionally being manufactured of brass and having low electrical resistance, so as to have a relatively high electrical resistance selected so as to self-heat under carried currents slowly relative to the self-heating of the bimetal. At high current levels, such as in a short circuit situation, the bimetallic heating is predominant and the heating in the terminals has a negligible effect, but toward the other end of the current scale, for example with a bare overload current flowing, the self-heating of the terminals can contribute significantly to the overall switch operation.

An embodiment of the invention which will hereinafter be described consists of a switch similar in construction to that shown in British Pat. No. 903807, except that the bimetal is mounted by its centre leg rather than by the bridge joining its outer legs. In previous switches of this construction, the terminations and mounting points have overlapped, necessitating the fabrication of these parts individually from separate sheets of metal, and these parts have provided a comparatively low resistance path for the passage of current. The present invention produces the parts in long thin form, giving increased resistance, and yet enabling them to be held rigidly in place to minimize the mechanical tolerances of the construction. These termination and mounting parts are preferably constructed of relatively high resistance material such as nickel chromium alloy or stainless steel in order to provide a relatively high resistance in the terminations. The terminations are rigidly encased in a thermo-plastics or thermosetting molding to give rigid construction with small dimensions.

The bimetal blade may be of any shape, with or without snap action, and may be made of a lower resistance alloy than that required in the previous devices as shown in British Pat. No. 903807.

In operation of the improved switch, during the passage of high currents when the motor is subjected to full torque loading or short term stall, the heat generated in the terminals does not have time to reach the bimetal, and only the self heating of the bimetal under its own resistance causes the temperature of the bimetal to rise. Because the bimetal has a comparatively low resistance, its temperature rise in the first few seconds of stall is not sufficient to cause the protector to open circuit. If the stall persists, then the protector will snap open its contact to protect the motor and reclose them when the bimetal has cooled to the remake temperature. The energy input to the windings will cause them to increase in temperature and hence resistance, resulting in a falling stall current. This is shown in FIG. 1. During this time, the effect of the terminal heating will reach the bimetal, thus counteracting the lower heating effect of a reducing current in the bimetal. It can be seen that a bimetal blade with resistive terminals will respond to a lower value of current than a similar unit with brass terminals. The steep time/current characteristic of the improved device are shown in FIG. 1 superimposed on the characteristics of conventional devices set to break at 130° C. and with an ambient temperature of 20° C.±2° C. and it can be seen that the curve for the device of the invention is much steeper than for the previous devices. One major advantage of this construction is that the characteristics of a number of bimetals of the previous design are crossed by the characteristic of this device. Thus, one device according to the invention with a particular bimetal will perform the same function as several prior art devices using different bimetals. This reduces the number of variations to be manufactured and saves in work in progress in the manufacturing process.

The invention will best be understood by consideration of the following description of an exemplary embodiment of the invention which is illustrated in the accompanying drawings.

BRIEF DESCRIPTION OF THE DRAWINGS

FIG. 2-1 is a plan view of a first terminal part having an extension for mounting a fixed contact of the switch;

FIGS. 2-2, 2-3 and 2-4 are plan, end elevation and side elevation views, respectively, of a second terminal part having an extension for mounting a bimetallic switch-actuating element of the switch;

FIG. 2-5 shows an exemplary bimetallic switch-actuating element; and

FIGS. 2-6, 2-7, 2-8, 2-9 and 2-10 show a complete switch according to the invention, respectively in plan, first and second side elevation, end elevation and sectional (on the line A—A in FIG. 2-6) views.

DESCRIPTION OF PREFERRED EMBODIMENT

Figure 1:
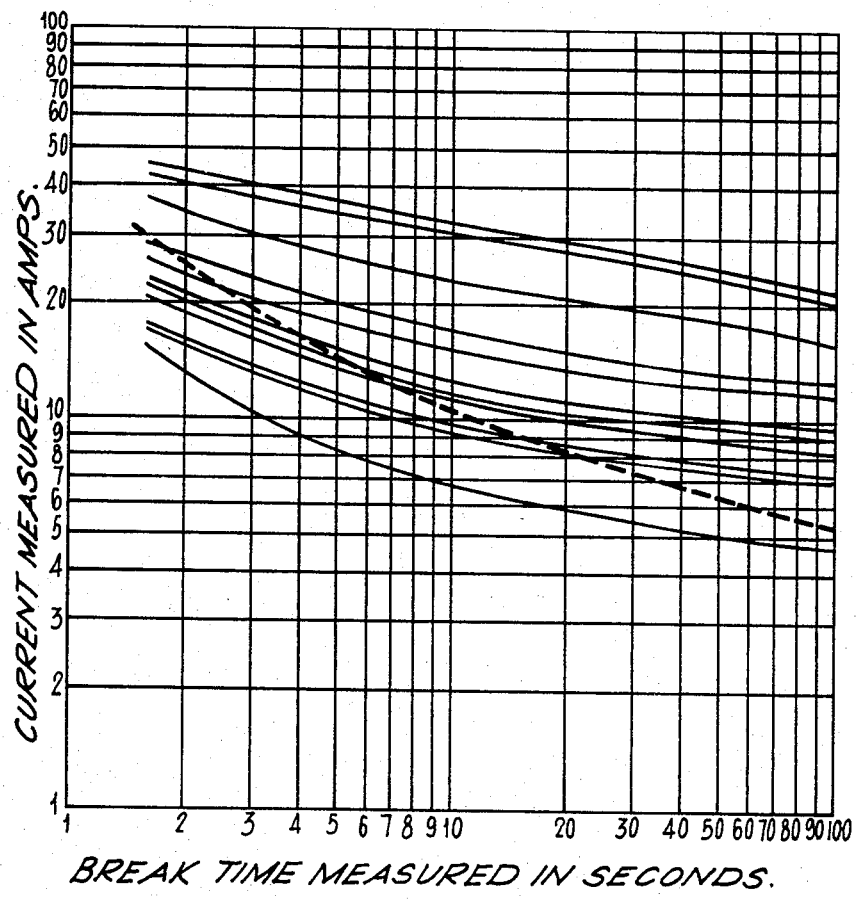
FIG. 1 is a graphical representation of the relationship between current load (measured in amperes) and break time (measured in seconds) for a variety of prior art switches (shown by continuous lines in the graph) and for an exemplary switch constructed in accordance with the present invention (the broken line in the graph)
Figures 1, 2:
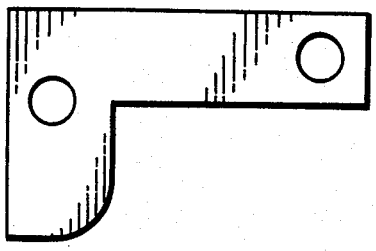
Figure 2:
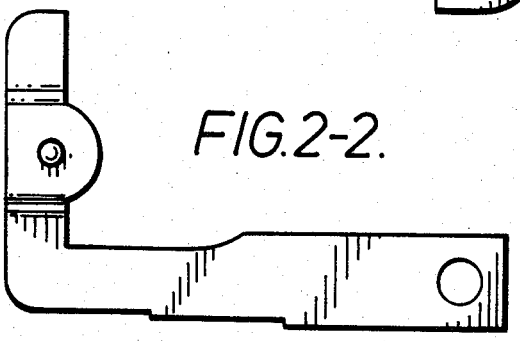
Figures 2, 3:
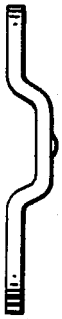
Figures 2, 3, 4:
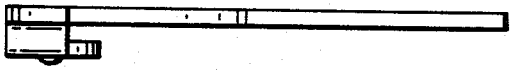
Figures 2, 3, 4, 5:
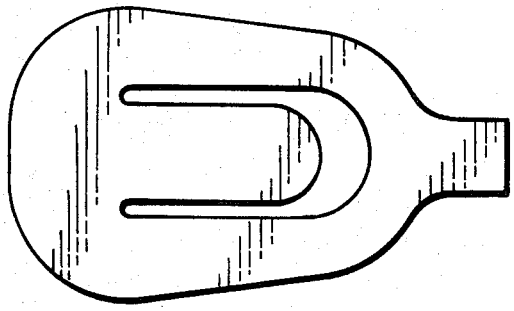

FIGS. 2-1 to 2-10 of the accompanying drawings show the arrangement of a typical protector switch according to the present invention with the particular switch parts in the different figures being designated with the same number as the respective figure which illustrates the part. More particularly, FIGS. 2-1 and 2-2 show the terminal and bimetal and fixed contact mounting parts formed, for example, of 18/8 Nickel/Chrome stainless steel by stamping and pressing from a continuous strip, conveniently in a continuous comb, wherein the two parts are arranged with one another in the relative positions they have in the finished protector switch, thereby facilitating production molding of the synthetic plastic body portion of the switch. FIGS. 2-3 and 2-4 show respective side elevations of the bimetal mounting part and illustrate the formation of an extended L-shaped limb portion having pressed therein a bridge onto which the tongue of a snap-acting bimetal (hereinafter described) is secured, as by welding. The part of FIG. 2-1 serves for mounting the fixed contact of the switch.

FIG. 2-5 shows an exemplary form of bimetallic blade which can be used, and a fuller description of such a blade is to be found in British Patent Application No. 8320052 and in coresponding German Patent Application No. P3327511.4, Japanese Patent Application No. 139329/1983 and U.S. patent application Ser. No. 517300, the disclosure whereof is incorporated herein by reference. The blade is dished so as to be movable with snap-action between two oppositely curved configurations and is generally pear-shaped with a U-shaped cut-out defining a tongue which serves for mounting the blade to the bridge portion of the part shown in FIGS. 2-2 to 2-4, the tip end of the tongue being spot welded to the bridge. The moving contact of the protector switch will be mounted at the narrow end of the blade between the bight of the U-shaped cut-out and the adjacent "nose" formed on the blade for cooperation with a backstop 10 formed in the body portion of the switch for limiting the contacts opening movement of the bimetal blade. As is more fully described in the patent applications abovementioned, the side portions of the bimetallic blade on either side of the tongue are tapered, as can be seen in FIG. 2-5, from the major end portion of the blade in the region of the root end of the tongue toward the minor end portion of the blade in the region of the bight of the U-shaped cut-out. This blade configuration is advantageous in that the pear-like blade shape coupled with the thinning of the outer side legs towards the smaller end of the blade provides improved mechanical switching characteristics and improved self-heating characteristics in the blade, leading to improved consistency of operation.

FIGS. 2-6 to 2-10 show the terminal and mounting parts of FIGS. 2-1 to 2-4 assembled with a molded switch body portion 20, such assembly being effected by injection molding of the body portion around the terminal and mounting parts, but do not show the bimetal mounted on the switch, though in FIG. 2-6 the outline of the bimetal is shown in broken lines to indicate how it is mounted. A more detailed description of the switch need not be given herein since in many respects the construction and arrangement of the parts of the switch are similar to those of the Type G65 switch produced and marketed by Otter Controls Limited of Buxton, Derbyshire, England, and a reading of the accompanying drawings will reveal to those skilled in the art such differences as do exist over and above the differences in accordance with the invention in the electrical resistances of the component parts, achieved in part by selection of materials and also by adoption of different dimensions.

In the prior art protector shown in British Pat. No. 903807 it was frequently necessary to calibrate the device to a temperature tolerance of ±5° C. in order accurately to match the characteristics required at both ends of the break time scale. In the device according to the invention, it is usually sufficient to calibrate the device using a measurement of the break time on a given current with a wide tolerance band. In previous devices, the resistance of the bimetal was critical in determining the band width of the characteristics and the varying characteristics of bimetal caused the yield to change with different batches of bimetal. In the device according to the invention, the terminals may be more resistive than the bimetal blade, so that variations in the bimetal resistance have a comparatively lesser effect on the overall characteristics of the switch. The effect of resistance heating in the terminations is to increase the general ambient temperature within the protector housing, and this gives rise to a longer remake time with fewer cycles during the stall time.

Two exemplary switches constructed as hereinbefore described had a terminal-to-terminal resistance in the contacts closed condition of 22 milli-ohms and 40 milli-ohms, respectively, with respective bimetal resistances (i.e.) the contribution of the bimetal alone to the terminal-to-terminal resistance) of 2 milli-ohms and 20 milli-ohms. The higher resistance switch was designed for use in relatively low current situations.

The use of thermo-plastics in the construction of the switch, together with high resistance parts, could in theory lead to the heating of the resistive parts causing melting of the thermo-plastic. However, it has been found that for bimetal snap temperatures below 170° C., the device is self-protecting since the heat generated in the terminals causes the bimetal snap member to operate before the nylon reaches its melting temperature. The use of a molded unit increases the thermal mass of the switch and adds to the advantages of low current sensitivity to high currents for short term use. This device also has advantages in the protection of large mains voltage motors such as washing machine motors with switched poles. The protector must allow the motor to produce full torque at almost stall current during the run-up to full spin speed, when water is still present in the drum, and this requires that the protector be insensitive to high currents for ca. 10 secs. At the same time, the protector must protect against stall currents over a longer period, and the resistive terminal members provide sufficient heat to trip the switch on the lower stall current with increasing winding temperatures. Previously devices have had to be calibrated to closer temperature tolerances, and it is now possible to protect the motor with a protector having a wide variety of snap temperatures. This increases the yield available during manufacture and lowers the manufacturing costs.

I claim:

1. An overload protection switch for an electric motor, comprising (a) a snap-acting bimetallic switch-actuating element;

(b) a first terminal part mounting said bimetallic switch-actuating element;

(c) a moving contact carried by said bimetallic switch-actuating element;

(d) a fixed contact cooperating with said moving contact; and (e) a second terminal part mounting said fixed contact;

(f) said first terminal, said bimetallic switch-actuating element, said moving and fixed contacts and said second terminal being electrically connected in series in said switch for carrying the electric load current of said motor when, in use of said switch, said switch is connected to said motor such that the electric load current of said motor flows through said switch; and (g) at least one of said first and second terminal parts being in heat transfer relation with said bimetallic switch-actuating element and being formed of a material having a relatively high electrical resistance selected such that the respective part self-heats under load currents of said switch slowly relative to the self-heating of said bimetallic switch-actuating element, the arrangement being such that in response to a relatively high overload current level the self-heating of said bimetallic switch-actuating element predominates in determining a rapid operation of said switch, with the heating of said at least one part having a substantially negligible effect upon said switch operation, whereas in response to a current level barely of an overload level the self-heating of said at least one part and the transfer of heat therefrom to said bimetallic switch-actuating element contributes significantly to a relatively slow operation of said switch, whereby said switch is capable of carrying a relatively short-lived but normal full torque current of said motor without operating to open its contacts but will operate to open its contacts in due course in the event of a high load current being maintained for too long.

2. An overload protection switch as claimed in claim 1, wherein said at least one of said first and second terminal parts formed of a relatively high resistance material furthermore is geometrically configured for increased electrical resistance.

3. An overload protection switch as claimed in claim 1, wherein said at least one of said first and second terminal parts formed of a relatively high resistance material comprises nickel/chromium stainless steel.

4. An overload protection switch as claimed in claim 1, comprising a molded plastic body portion, and wherein said first and second terminal parts are secured in said body portion and have extensions serving respectively as a mounting for said bimetallic switch actuating element and a mounting for said fixed contact of the switch.

5. An overload protection switch as claimed in claim 4, wherein both of said first and second terminal parts are formed of said relatively high resistance material.

6. An overload protection switch as claimed in claim 1, wherein said bimetallic switch-actuating element comprises a stressed bimetallic blade movable with a snap-action between two oppositely dished configurations, said blade having a generally U-shaped cut-out defining a tongue extending between two side portions of said blade, said tongue having a rod end and a tip end and said blade being mounted in the switch by virtue of said tip end of said tongue being fixed to said first terminal part, said blade further having a portion which bridges said two side portions of said blade in the region of the bight of said U-shaped cut-out and said movable contact being mounted on said bridging portion.

7. An overload protection switch as claimed in claim 6, wherein said bimetallic blade is generally pear-shaped with a major portion in the region of the root end of said tongue and minor portion in the region of the tip end of said tongue, said major and minor portions being at opposite ends of the two side portions of said blade.

8. An overload protection switch as claimed in claim 7, wherein the side portions of said bimetallic blade are tapered from the major portion toward the minor portion of said blade.

9. An overload protection switch as claimed in any one of claims 1 to 5, wherein a back-stop is defined in said switch for limiting the contacts-opening movement of said bimetallic switch-actuating element.

10. An overload protection switch according to claim 1, coupled in series with the windings of an electric motor.

* * * * *